US012152832B2

(12) United States Patent
Lam et al.

(10) Patent No.: US 12,152,832 B2
(45) **Date of Patent: *Nov. 26, 2024**

(54) SHELF ASSEMBLY FOR AN APPLIANCE

(71) Applicant: WHIRLPOOL CORPORATION, Benton Harbor, MI (US)

(72) Inventors: Prasanth A. Lam, Kankipadu (IN); Vijaya Hanamant Bichakar, Karod (IN); Ratul Maity, Howrah (IN); Mukesh Muthamilan, Chennai (IN); Hrushikesh C. Prabhu, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 26 days.

This patent is subject to a terminal disclaimer.

(21) Appl. No.: 18/080,117

(22) Filed: Dec. 13, 2022

(65) Prior Publication Data

US 2023/0175768 A1 Jun. 8, 2023

Related U.S. Application Data

(63) Continuation of application No. 16/883,851, filed on May 26, 2020, now Pat. No. 11,578,909.

(51) Int. Cl.
*F25D 25/02* (2006.01)
*A47B 96/02* (2006.01)

(52) U.S. Cl.
CPC ..... *F25D 25/027* (2013.01); *A47B 96/025* (2013.01); *F25D 25/024* (2013.01); *F25D 2325/021* (2013.01)

(58) Field of Classification Search
CPC .. F25D 25/027; F25D 25/04; F25D 2325/021; F25D 25/024; F25D 25/021; F25D 25/02; A47B 96/025
See application file for complete search history.

(56) References Cited

U.S. PATENT DOCUMENTS

| | | | |
|---|---|---|---|
| 2,640,599 | A | 6/1953 | McD.Hess |
| 2,926,507 | A | 3/1960 | Ingolia |
| 3,184,276 | A | 5/1965 | Billups |

(Continued)

FOREIGN PATENT DOCUMENTS

| | | | |
|---|---|---|---|
| CN | 105758084 | A | 7/2016 |
| CN | 10644602 | A | 2/2017 |

(Continued)

*Primary Examiner* — Kimberley S Wright
(74) *Attorney, Agent, or Firm* — Price Heneveld LLP

(57) ABSTRACT

A shelf assembly for an appliance includes a shelf support operably coupled with a cabinet liner. First and second supports are positioned below the shelf support. The first and second supports are positioned on opposing sidewalls of the cabinet liner. A rear shelf portion is slidably supported on the shelf support between rearward and forward positions. A front shelf portion is positioned adjacent to the rear shelf portion and is movable between a raised position and a lowered position. A plurality of rotatable arms are configured to support the front shelf portion. Each rotatable arm of the plurality of rotatable arms is operably coupled with one of the first and second supports at a first end and is further operably coupled with the front shelf portion at a second end. A connecting arm interconnects the rear shelf portion and the front shelf portion.

17 Claims, 15 Drawing Sheets

(56) References Cited

U.S. PATENT DOCUMENTS

| | | | |
|---|---|---|---|
| 4,625,657 | A | 12/1986 | Little et al. |
| 5,224,677 | A | 7/1993 | Close |
| 5,299,863 | A | 4/1994 | Albright, Jr. |
| 7,628,461 | B2 | 12/2009 | Carden et al. |
| 7,654,208 | B2 | 2/2010 | Patten |
| 7,766,437 | B2 | 8/2010 | Lim et al. |
| 8,424,693 | B1 | 4/2013 | Hoover |
| 8,474,928 | B2 | 7/2013 | Ertz et al. |
| D695,796 | S | 12/2013 | Lee et al. |
| 8,814,287 | B2 | 8/2014 | Jang |
| 8,936,332 | B2 | 1/2015 | Park et al. |
| 9,170,043 | B2 | 10/2015 | Choo et al. |
| D745,581 | S | 12/2015 | Jeon et al. |
| 9,322,592 | B2 | 4/2016 | Kim et al. |
| 9,372,027 | B2 | 6/2016 | Yoo et al. |
| 9,464,841 | B2 | 10/2016 | Choo et al. |
| 9,726,423 | B1 | 8/2017 | Swarnkar |
| 9,803,916 | B2 | 10/2017 | Park et al. |
| 2006/0097613 | A1 | 5/2006 | Lee et al. |
| 2014/0001425 | A1 | 1/2014 | Falcon |
| 2016/0187054 | A1 | 6/2016 | Park et al. |
| 2018/0325286 | A1 | 11/2018 | Welk et al. |
| 2019/0162466 | A1 | 5/2019 | Yang et al. |
| 2020/0217582 | A1 | 7/2020 | Yu et al. |

FOREIGN PATENT DOCUMENTS

| | | | | | |
|---|---|---|---|---|---|
| CN | 106679315 | A | | 5/2017 | |
| CN | 109253581 | A | * | 1/2019 | ..... F25D 25/025 |
| CN | 109855381 | A | | 6/2019 | |
| CN | 209820101 | U | | 12/2019 | |
| EP | 3457058 | A1 | | 3/2019 | |
| JP | S597393 | A | | 1/1984 | |
| JP | 2004298218 | A | | 10/2004 | |
| KR | 20110037553 | A | | 4/2011 | |
| KR | 20110084689 | A | | 7/2011 | |
| KR | 20110088032 | A | | 8/2011 | |
| KR | 20110088636 | A | | 8/2011 | |
| KR | 20120020850 | A | | 3/2012 | |
| KR | 101763423 | B1 | | 7/2017 | |
| WO | 2015155118 | A1 | | 10/2015 | |
| WO | 2016129956 | A1 | | 8/2016 | |
| WO | 2018120126 | A1 | | 7/2018 | |
| WO | 2018130126 | A1 | | 7/2018 | |

* cited by examiner

SHELF ASSEMBLY FOR AN APPLIANCE

CROSS-REFERENCE TO RELATED APPLICATION

This application is a continuation of U.S. patent application Ser. No. 16/883,851, now U.S. Pat. No. 11,578,909, filed on May 26, 2020, entitled SHELF ASSEMBLY FOR AN APPLIANCE, the entire disclosure of which is hereby incorporated by reference.

FIELD OF DISCLOSURE

The present disclosure generally relates to a shelf assembly, and more specifically, to a shelf assembly for an appliance.

BACKGROUND

Shelf assemblies within appliances may have rear portions that are configured to support goods. The shelf assemblies may have various portions that are movable to increase user access.

SUMMARY OF THE DISCLOSURE

According to one aspect of the present disclosure, a shelf assembly for an appliance includes a shelf support operably coupled with a cabinet liner. First and second supports are positioned below the shelf support. The first and second supports are positioned on opposing sidewalls of the cabinet liner. A rear shelf portion is slidably supported on the shelf support between rearward and forward positions. A front shelf portion is positioned adjacent to the rear shelf portion and is movable between a raised position and a lowered position. A plurality of rotatable arms are configured to support the front shelf portion. Each rotatable arm of the plurality of rotatable arms is operably coupled with one of the first and second supports at a first end and is further operably coupled with the front shelf portion at a second end. A connecting arm interconnects the rear shelf portion and the front shelf portion.

According to another aspect of the present disclosure, a shelf assembly for an appliance includes a shelf support operably coupled with a cabinet liner. A rear shelf portion is slidably coupled with the shelf support and is movable between a forward position and a rearward position. A front shelf portion is positioned forward of the rear shelf portion and is movable between a raised position and a lowered position. At least one rotatable arm is configured to support the front shelf portion. The at least one rotatable arm is operably coupled with the cabinet liner at a first end and is operably coupled with the front shelf portion at a second end. A connecting arm is operably coupled with the rear shelf portion at a first end and is operably coupled with the front shelf portion at a second end.

According to yet another aspect of the present disclosure, a shelf assembly for an appliance includes a shelf support operably coupled with a cabinet liner. A rear shelf portion is slidably coupled with the shelf support between first and second positions. A front shelf portion is positioned forward of the rear shelf portion and is movable between first and second positions. The front shelf portion is substantially co-planar with the rear shelf portion when the front shelf portion is in the first position. A plurality of rotatable arms interconnect the front shelf portion and the cabinet liner. A connecting arm interconnects the rear shelf portion and one of the rotatable arms of plurality of rotatable arms.

These and other features, advantages, and objects of the present disclosure will be further understood and appreciated by those skilled in the art by reference to the following specification, claims, and appended drawings.

Figure 1:
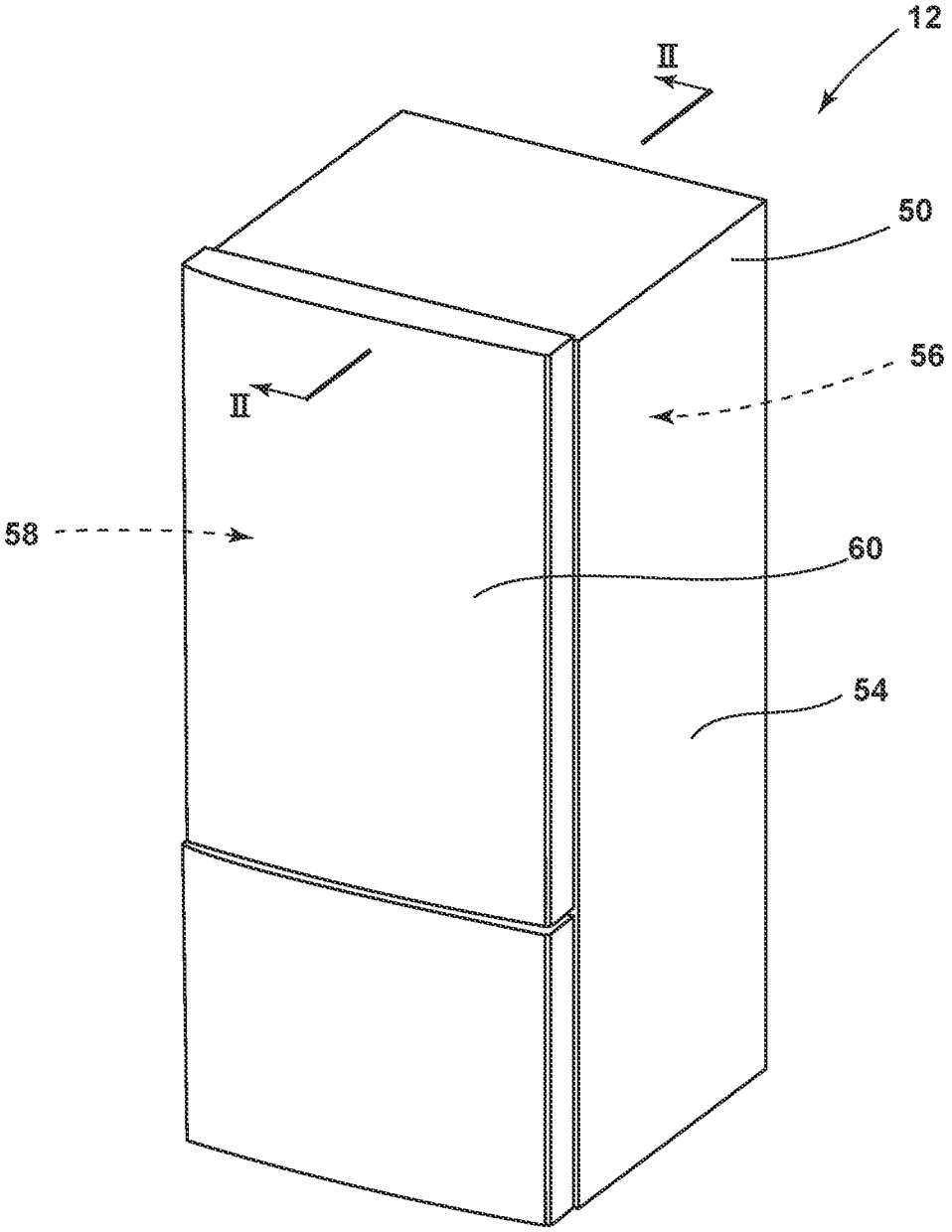
FIG. 1 is a side perspective view of a refrigerating appliance, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a shelf assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front"

shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-13, reference numeral 10 generally designates a shelf assembly for an appliance 12. The shelf assembly 10 includes a shelf support 14 operably coupled with a cabinet liner 16. First and second supports 18, 20 are positioned proximate the shelf support 14. The first and second supports 18, 20 are positioned on opposing sidewalls 22, 24 of the cabinet liner 16. A rear shelf portion 26 is slidably coupled with the shelf support 14. A front shelf portion 28 is positioned forward of the rear shelf portion 26 and is movable between a raised position and a lowered position. A plurality of rotatable arms 30 includes rotatable arms 30A-30D configured to support the front shelf portion 28 and guide the front shelf portion 28 rotatably between first and second position. Each rotatable arm 30A-30D of the plurality of rotatable arms 30 is operably coupled with one of the first and second supports 18, 20 at a lower end 32 and is further operably coupled with the front shelf portion 28 at an upper end 34. A connecting arm 36 is operably coupled with the front shelf portion 28 at a front end 38 and is operably coupled with the rear shelf portion 26 at a rear end 40.

Figure 2:
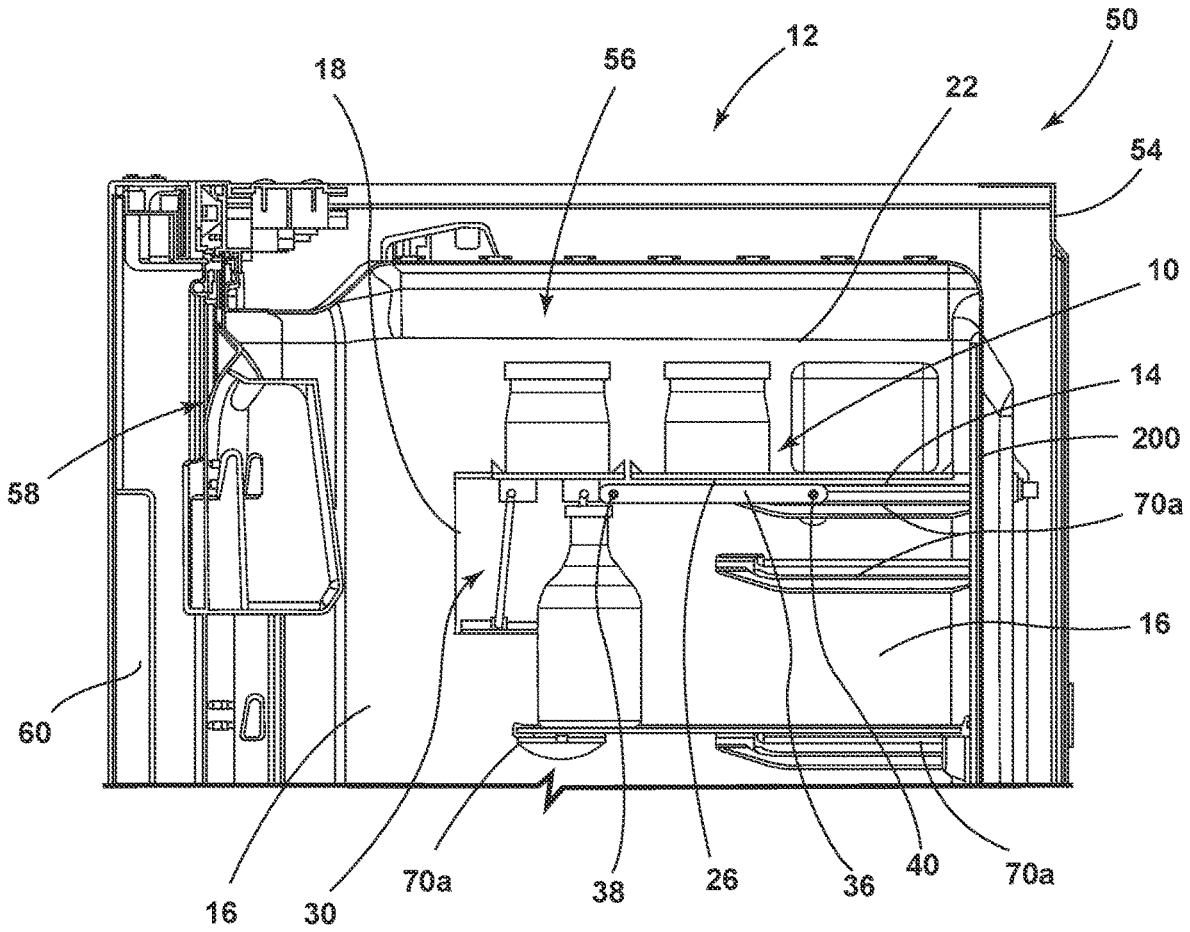
FIG. 2 is a cross-sectional view of the refrigerating appliance of FIG. 1 taken at line II including a shelf assembly.

Referring now to FIGS. 1 and 2, the appliance 12 is illustrated with a cabinet 50 including the cabinet liner 16 and an outer wrapper 54. The cabinet liner 16 defines a compartment 56 accessible by an access opening 58. A door 60 is configured to selectively cover the access opening 58 and seal the compartment 56. The appliance 12 is illustrated as a top mount refrigerator. However, it is within the scope of the disclosure for the cabinet 50 to include any suitable configuration, which may include a single door, a plurality of doors, French doors, drawers, etc. Accordingly, the cabinet liner 16 may define any suitable configuration of the interior compartment 56 based on the configuration of the cabinet 50. It is further contemplated that, in various examples, the cabinet 50 may be configured as a cabinet for use in a refrigerating appliance, such as a vacuum-insulated refrigerator, without departing from or limiting the scope of the present disclosure.

Figure 9:
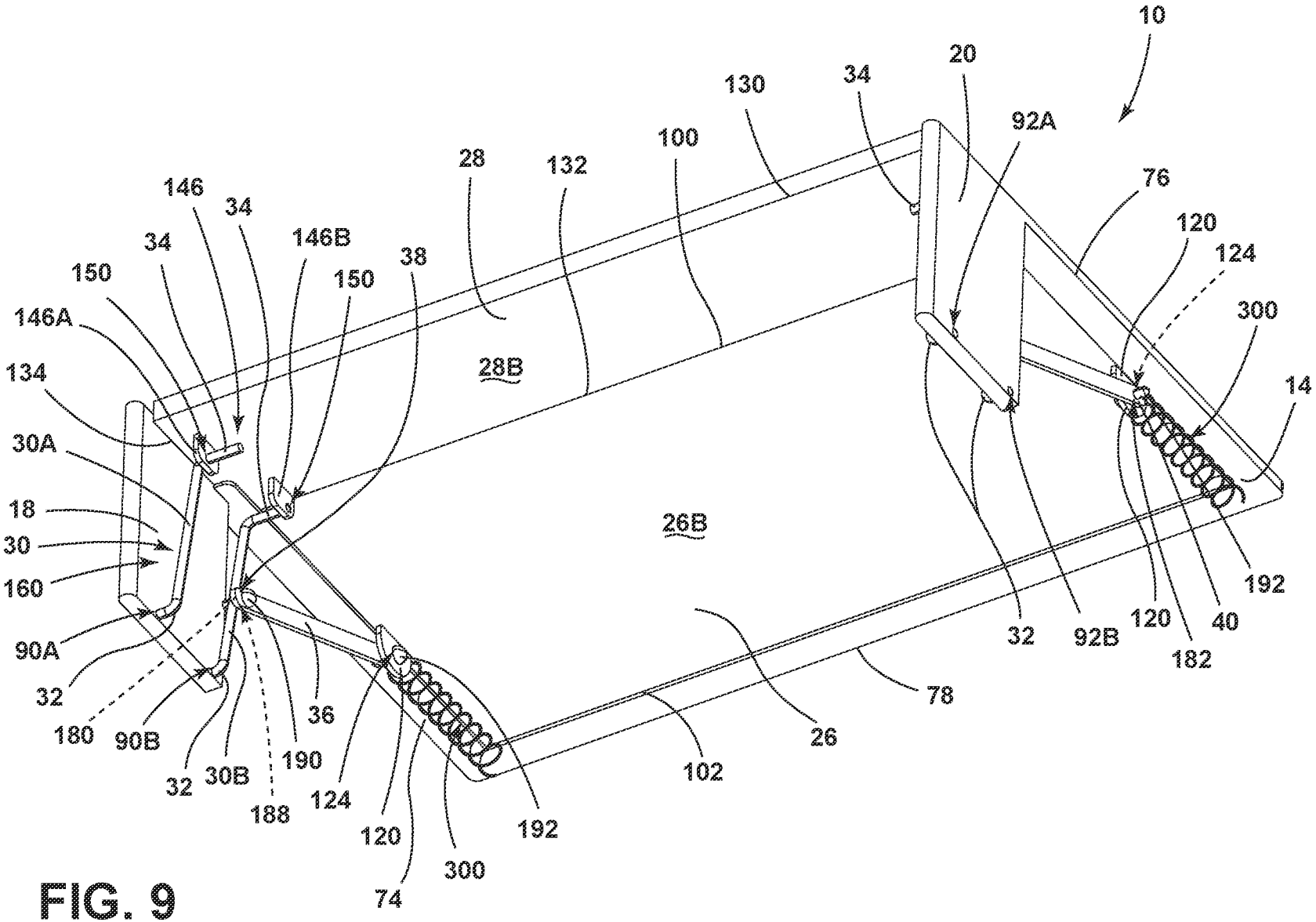
FIG. 9 is a top perspective view of a shelf assembly including a spring, according to various examples.
Figure 10:
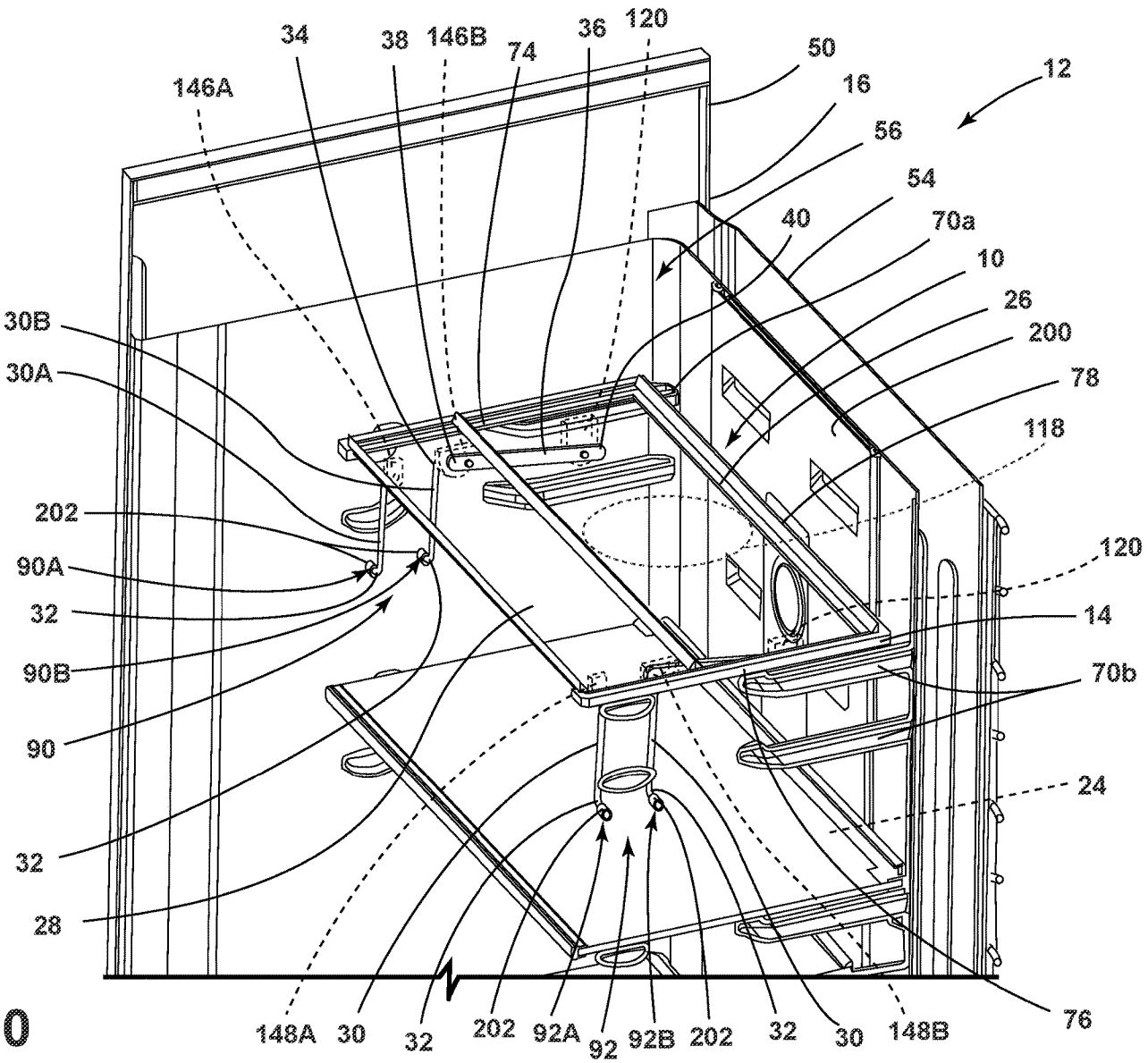
FIG. 10 is a top perspective view of a refrigerating appliance with a sidewall of the appliance removed to illustrate a shelf assembly in a first position, according to various examples.
Figure 11:
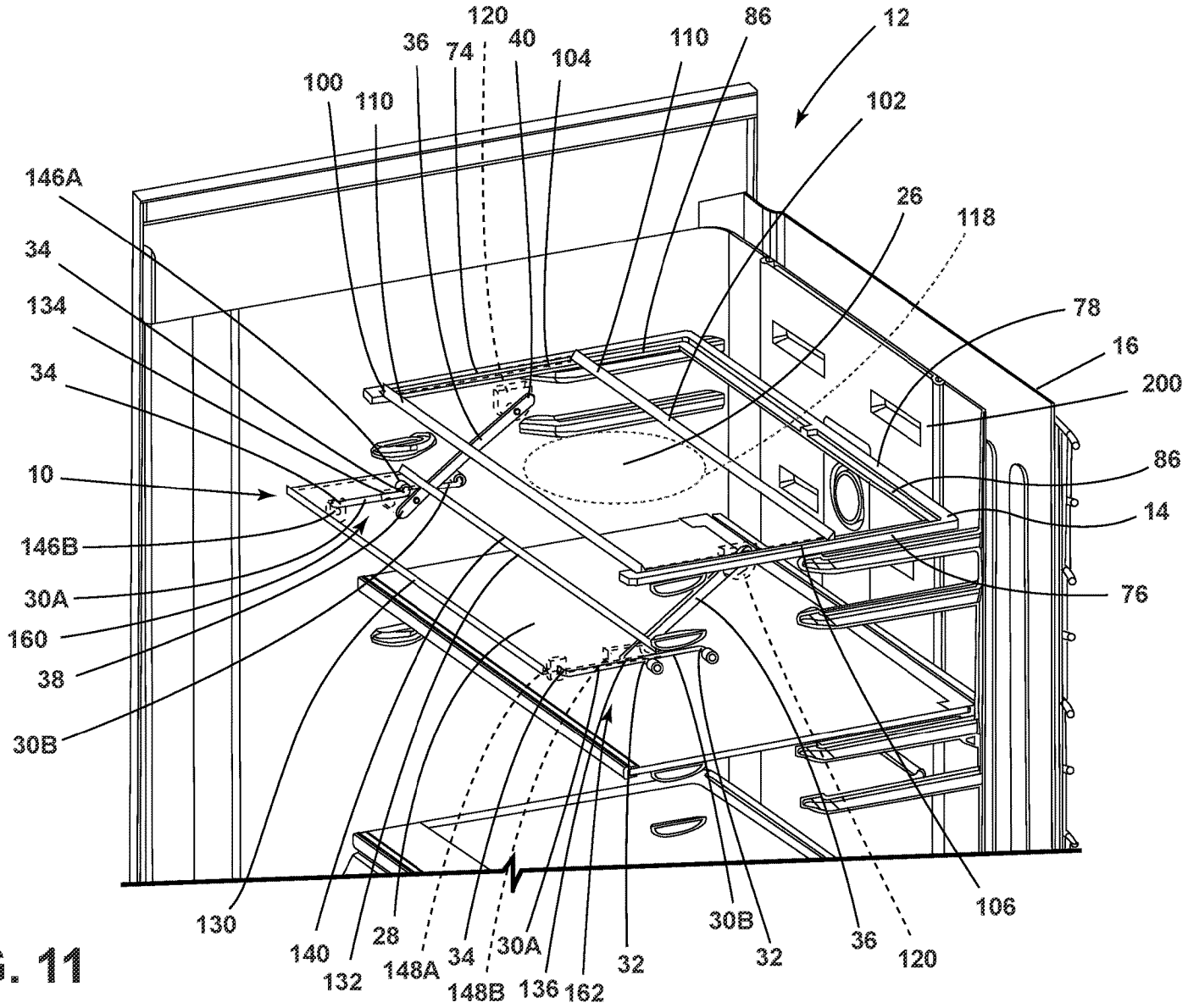
FIG. 11 is a top perspective view of the refrigerating appliance of FIG. 10 with the shelf assembly in the second position.

Referring now to FIGS. 2 and 10, the cabinet liner 16 may include mounts 70*a*, 70*b* extending inwardly into the compartment 56 from the first and second sidewalls 22, 24 of the cabinet liner 16. The mounts 70*a*, 70*b* may be vertically spaced-apart in any arrangement to provide a predetermined configuration of shelves within the compartment 56. As best shown in FIG. 9, the mounts 70*a*, 70*b* are oriented in pairs, such that a first mount 70*a* is positioned on the first sidewall 22 of the cabinet liner 16 and is aligned with the second mount 70*b* position on the second sidewall 24 of the cabinet liner 16. Each of the mounts 70*a*, 70*b* may be integrally formed with the cabinet liner 16 or may be operably coupled with the cabinet liner 16. As shown in FIGS. 2 and 9, the mounts 70*a* and 70*b* may include a plurality of rails that are vertically spaced-apart along the opposed first and second sidewalls 22, 24 of the cabinet liner 16 to support the shelf assembly 10, or other like shelf assemblies, in a fixed or slidable manner.

As illustrated in FIG. 10, the shelf support 14 includes a first side member 74 and a second side member 76 joined by a rear member 78. When the shelf support 14 is positioned within the compartment 56, the first side member 74 and the second side member 76 each rests on, and is supported by, one or more mounts 70*a*, 70*b* (see FIGS. 2 and 9). In various examples, the first and second side members 74, 76 may be coupled with the first and second sidewalls 22, 24 of the cabinet liner 16. In other examples, the first and second side members 74, 76 may be coupled with one of the pairs of first and second mounts 70*a*, 70*b*. The shelf support 14 is positioned such that the first side member 74 is substantially aligned with the first sidewall 22 of the cabinet liner 16, the second side member 76 is substantially aligned with the second sidewall 24 of the cabinet liner 16, and the rear member 78 is substantially aligned with a rear wall 200 of the cabinet liner 16.

Referring now to FIGS. 2-9, a first exemplary embodiment of the shelf assembly 10 is illustrated including the first and second supports 18, 20 extending downwardly from the first and second side members 74, 76, respectively. The shelf assembly 10 is positioned within the compartment 56 and includes the shelf support 14, the front shelf portion 28, and the rear shelf portion 26. In various examples, the front shelf portion 28 and the rear shelf portion 26 are each at least partially supported by the shelf support 14. In other examples, the rear shelf portion 26 is supported by the shelf support 14, and the front shelf portion 28 is supported by the plurality of rotatable arms 30. The front shelf portion 28 and the rear shelf portion 26 may be referred to herein as first and second portions of the shelf assembly 10.

As illustrated in FIGS. 2 and 9, the first side member 74 may be integrally formed with the first support 18, and the second side member 76 may be integrally formed with the second support 20. Each of the first and second supports 18, 20 may be substantially rectangular and may extend downward from a forward end of the respective side member 74, 76. In this way, the first and second supports 18, 20 define opposed forward supports for the shelf assembly 10. The first and second supports 18, 20 may be operably coupled with the first and second sidewalls 22, 24 of the cabinet liner 16. Alternatively, the first and second supports 18, 20 may be supported by the shelf support 14.

Each of the first and second side members 74, 76 may include an inwardly extending support rail 86. The inwardly extending support rail 86 extends from the respective side member 74, 76 away from the respective sidewall 22, 24 of the cabinet liner 16. The inwardly extending support rail 86 is sized to support for one or both of the front shelf portion 28 and the rear shelf portion 26 on an upper surface thereof. In various examples, the inwardly extending support rail 86 may be configured to extend from the rear member 78 to the forward end of the respective side member 74, 76. In other examples, the inwardly extending support rail 86 may be configured to extend along a portion of the respective side member 74, 76. The inwardly extending support rail 86 may extend to the respective support 18, 20 or may extend along at least a part of the respective support 18, 20.

Figure 5A:
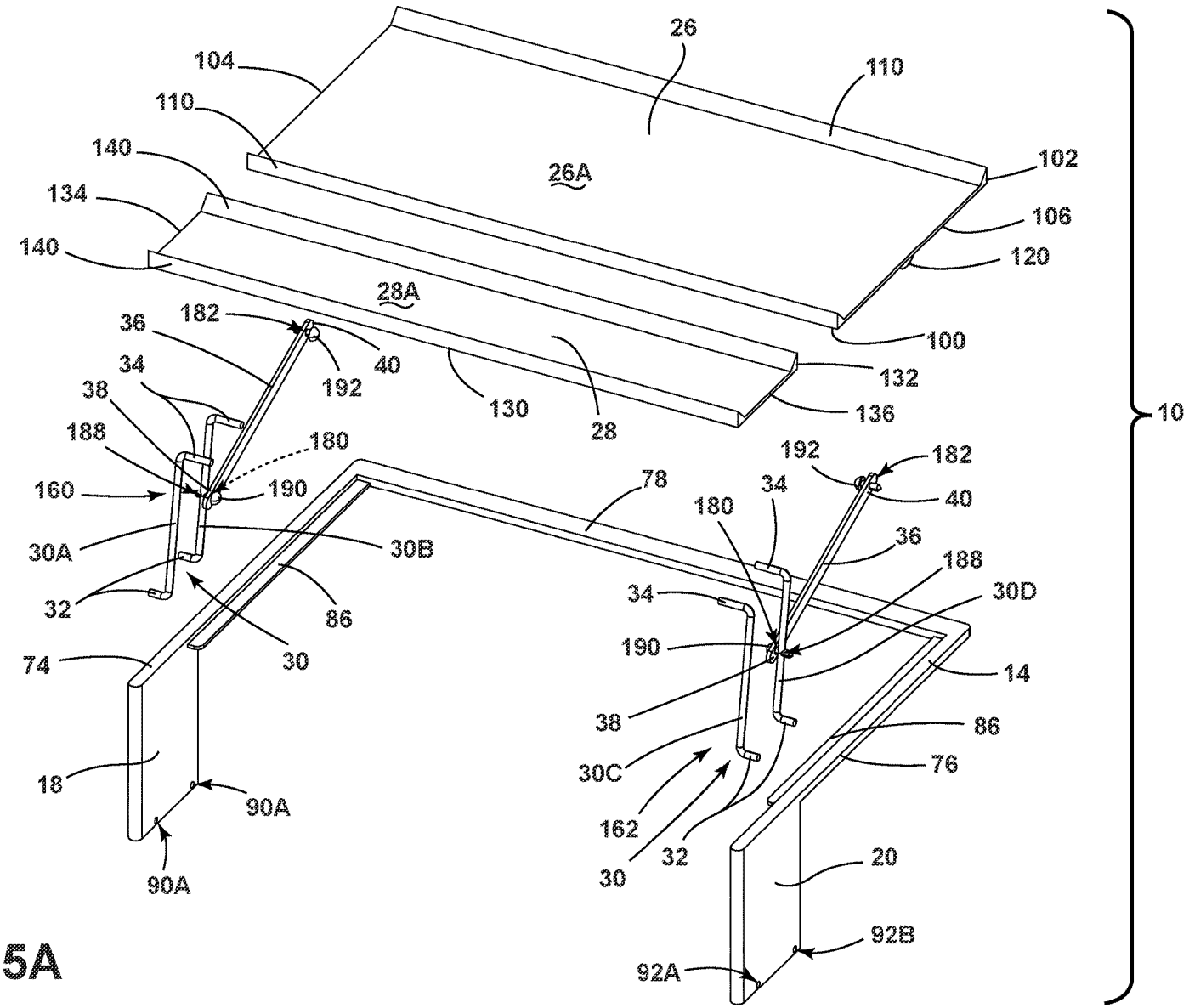
FIG. 5A is an exploded, top perspective view of the shelf assembly of FIG. 3.
Figure 5B:
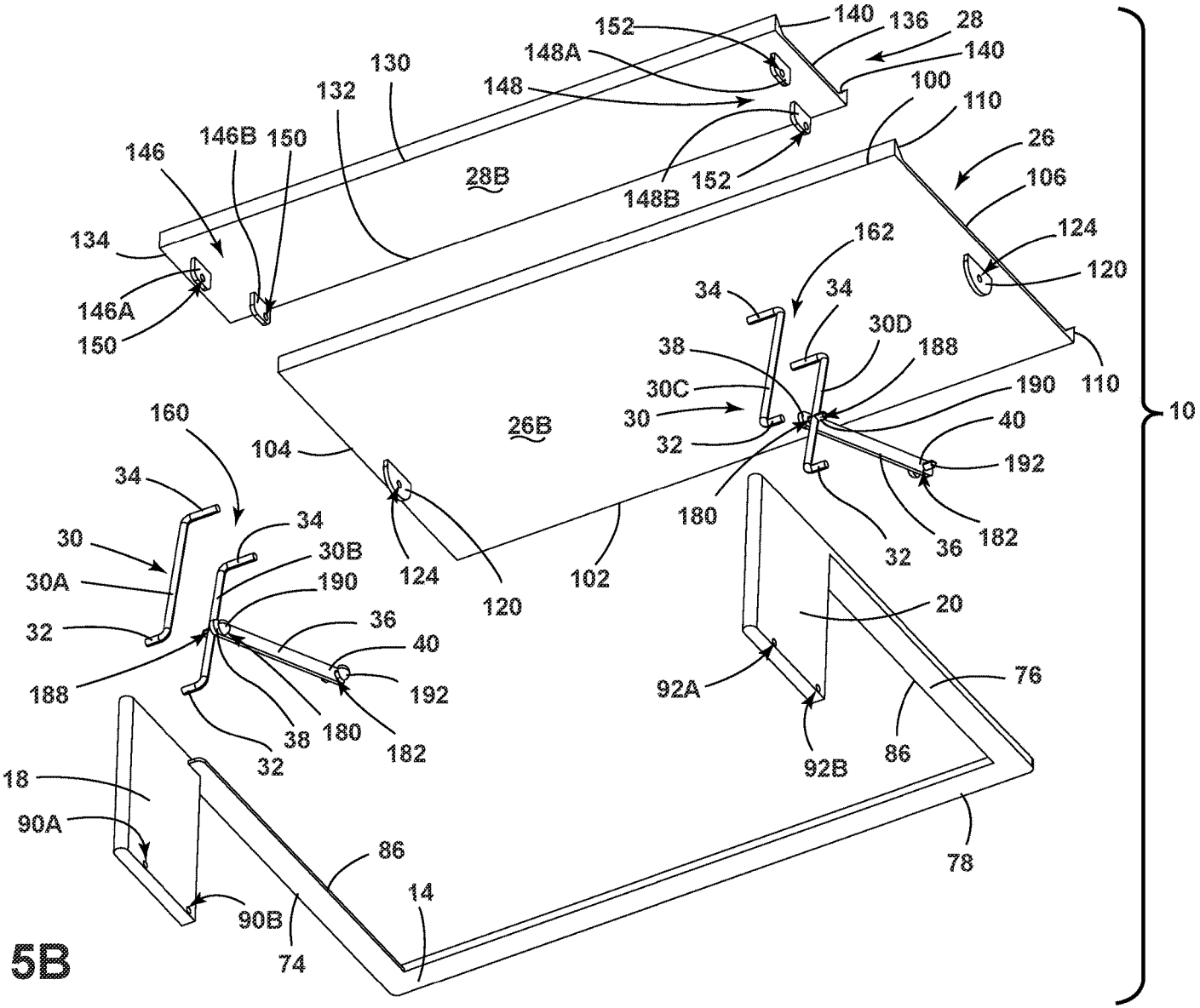
FIG. 5B is an exploded, bottom perspective view of the shelf assembly of FIG. 3.

As best shown in FIGS. 5A and 5B, the first support 18 defines a first pair of receiving wells 90 having first and second receiving wells 90A, 90B. The second support 20 defines a second pair of receiving wells 92 having first and second receiving wells 92A, 92B. The first pair of receiving wells 90 may be defined proximate a bottom edge of the first support 18, and the second pair of receiving wells 92 may be defined proximate a bottom edge of the second support 20. The second pair of receiving wells 92 may be defined to mirror the size, position, and spacing of the first pair of receiving wells 90. It will be understood that the first and second pair of receiving wells 90, 92 may be defined in any position on any portion of the first and second supports 18, 20 without departing from the scope of the present disclosure. As shown in FIGS. 5A and 5B, the first receiving wells 90A, 92A are positioned in forward positions relative to the second receiving wells 90B, 92B in both the first and second pairs of receiving wells 90, 92.

Figure 6:
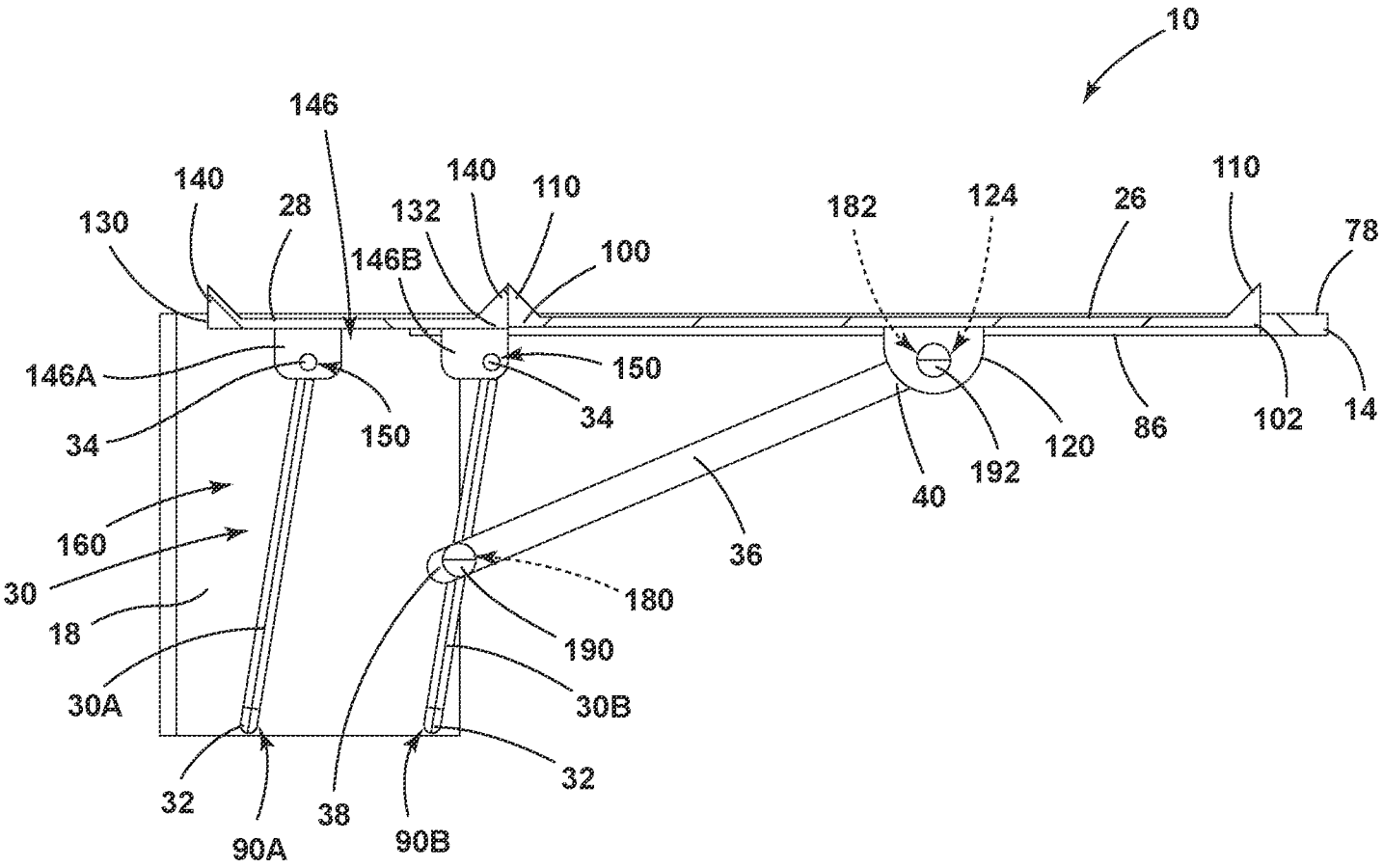
FIG. 6 is a cross-sectional view of the shelf assembly of FIG. 3 taken at line VI with the shelf assembly shown in a first position, according to various examples.
Figure 7A:
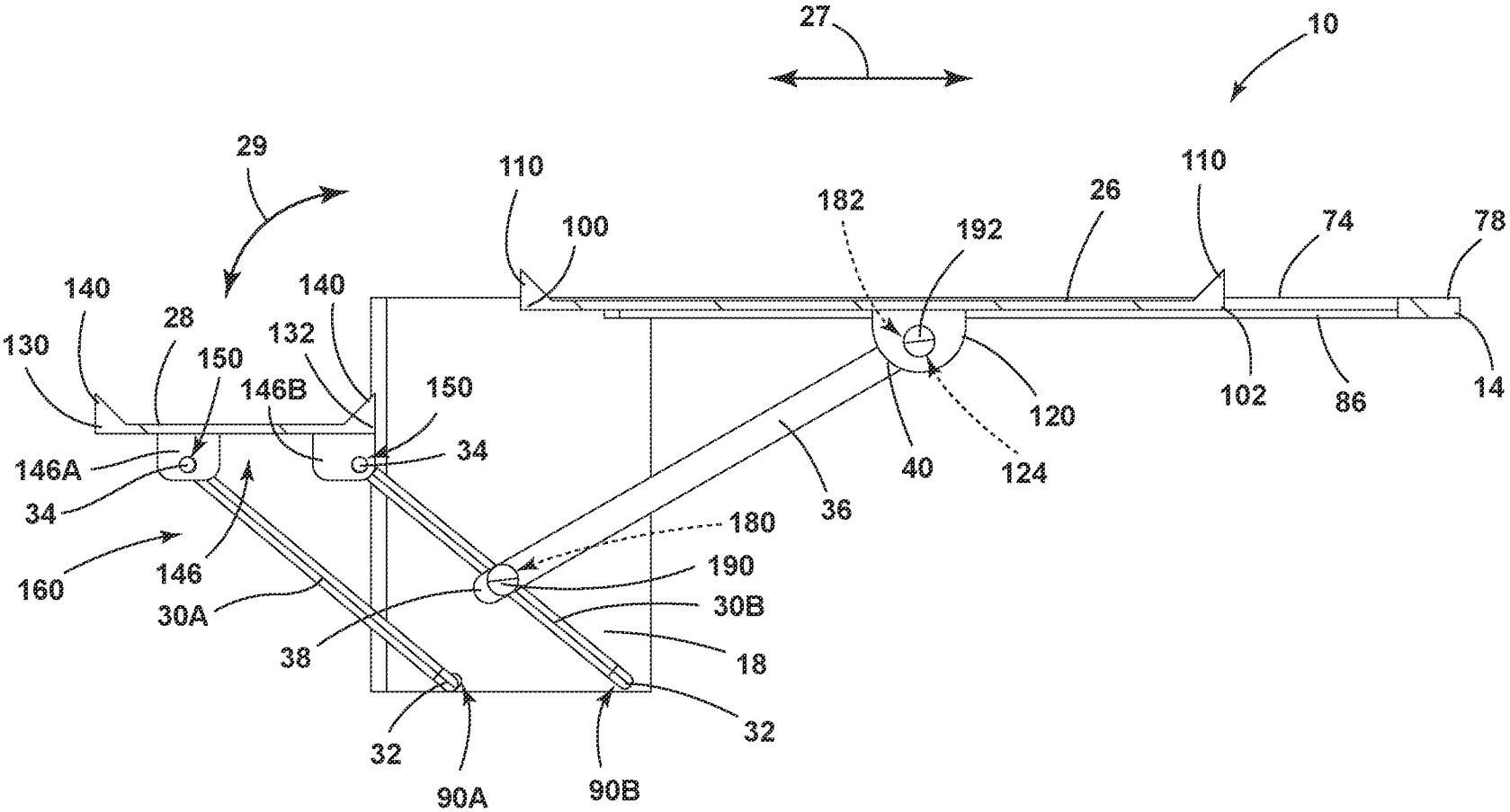
FIG. 7A is a side elevational view of the shelf assembly of FIG. 6 shown in an intermediate position.
Figure 7B:
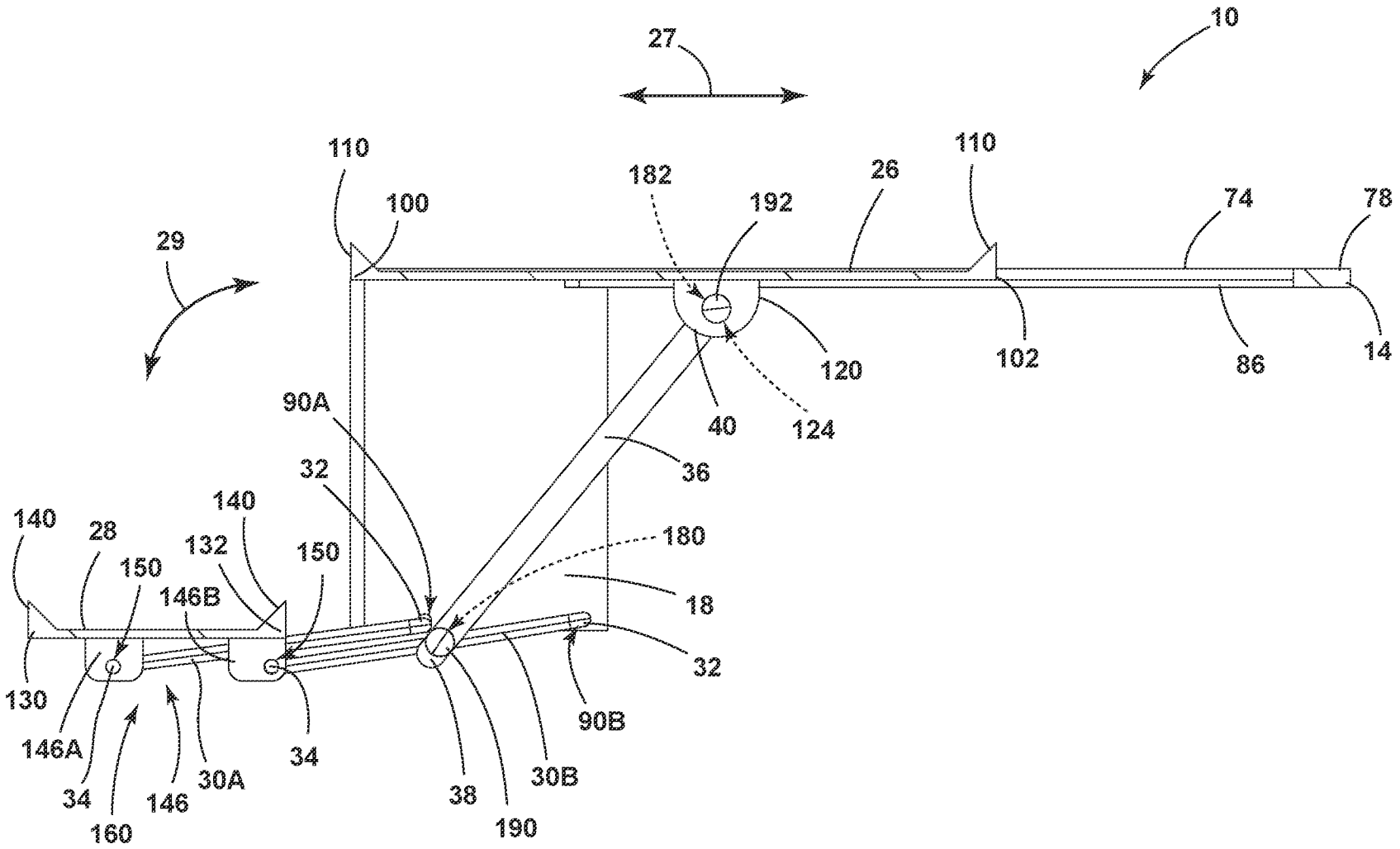
FIG. 7B is a side elevational view of the shelf assembly of FIG. 7A in a second position.

As best illustrated in FIGS. 3-7B, the rear shelf portion 26 is substantially rectangular and includes a forward edge 100, a rear edge 102, a first side edge 104, a second side edge 106, and upper and lower surfaces 26A, 26B. The rear shelf portion 26 is slidably coupled with the shelf support 14 and is movable between a forward position and a rearward position in a direction as indicated by arrow 27 (FIGS. 7A-7B). For example, the first and second side edges 104, 106 of the rear shelf portion 26 may be slidably coupled with the inwardly extending support rails 86 of the shelf support 14 or may be coupled with a slide assembly (not shown) coupled with or integrally formed with the inwardly extending support rails 86 and/or the first and second side members 74, 76. When the rear shelf portion 26 is in the rearward position (FIGS. 2-4), the rear edge 102 of the rear shelf portion 26 is aligned with and/or abuts the rear member 78 of the shelf support 14. When the rear shelf portion 26 is in the forward position (FIG. 7B), the rear edge 102 of the rear shelf portion 26 is spaced-apart from the rear member 78 of the shelf support 14.

In various examples, one or both of the forward edge 100 and the rear edge 102 of the rear shelf portion 26 may include a raised edge 110. The raised edge 110 may have a substantially triangular cross-section. The cross-section is configured such that an angled portion of the raised edge 110 is oriented away from the respective edge 100, 102. The one or more raised edges 110 may improve retention of any contents supported on the rear shelf portion 26 when the rear shelf portion 26 is moved between the forward position and the rearward position.

Figure 3:
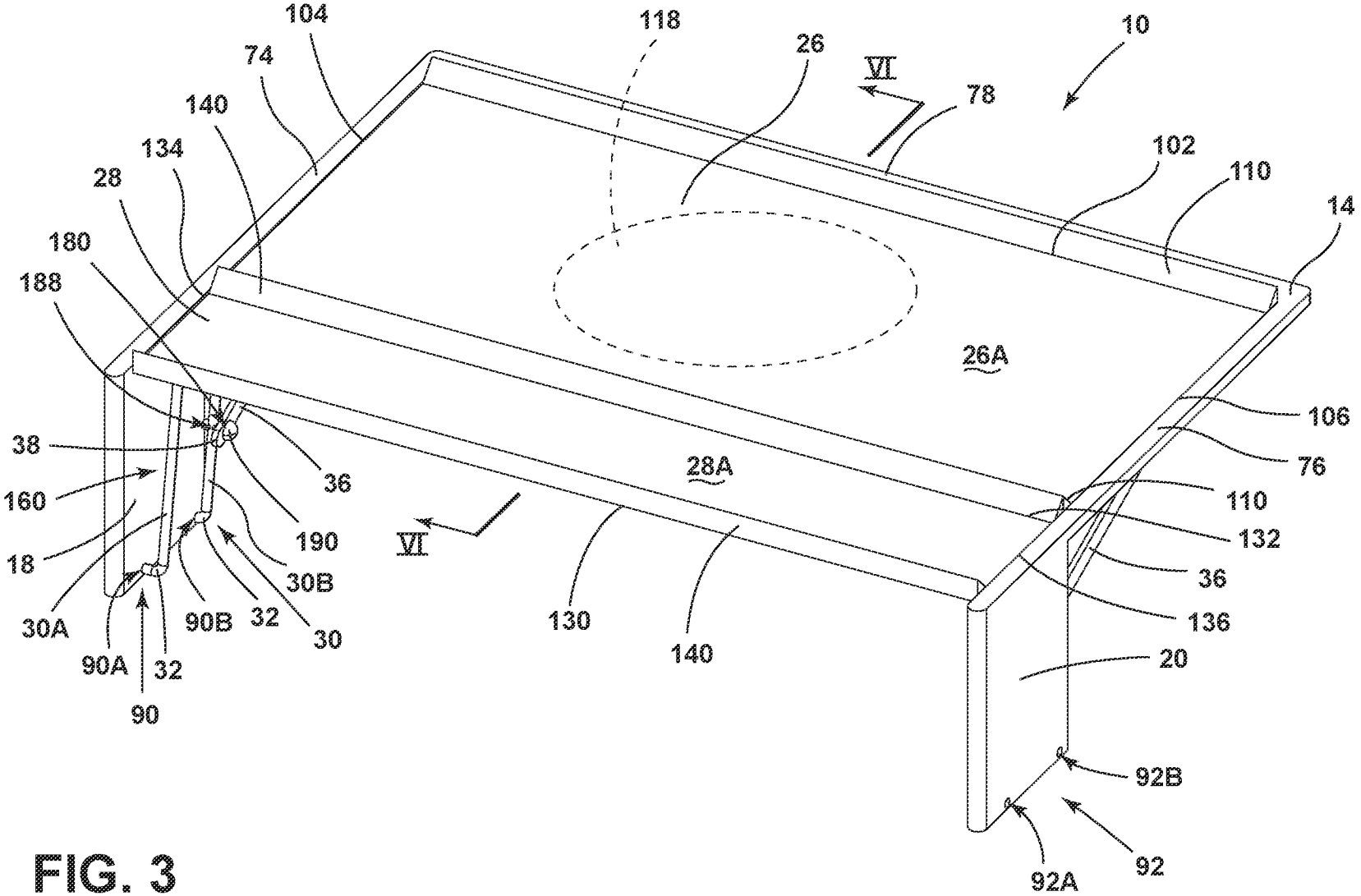
FIG. 3 is a top perspective view of the shelf assembly of FIG. 2 removed from the appliance.
Figure 4:
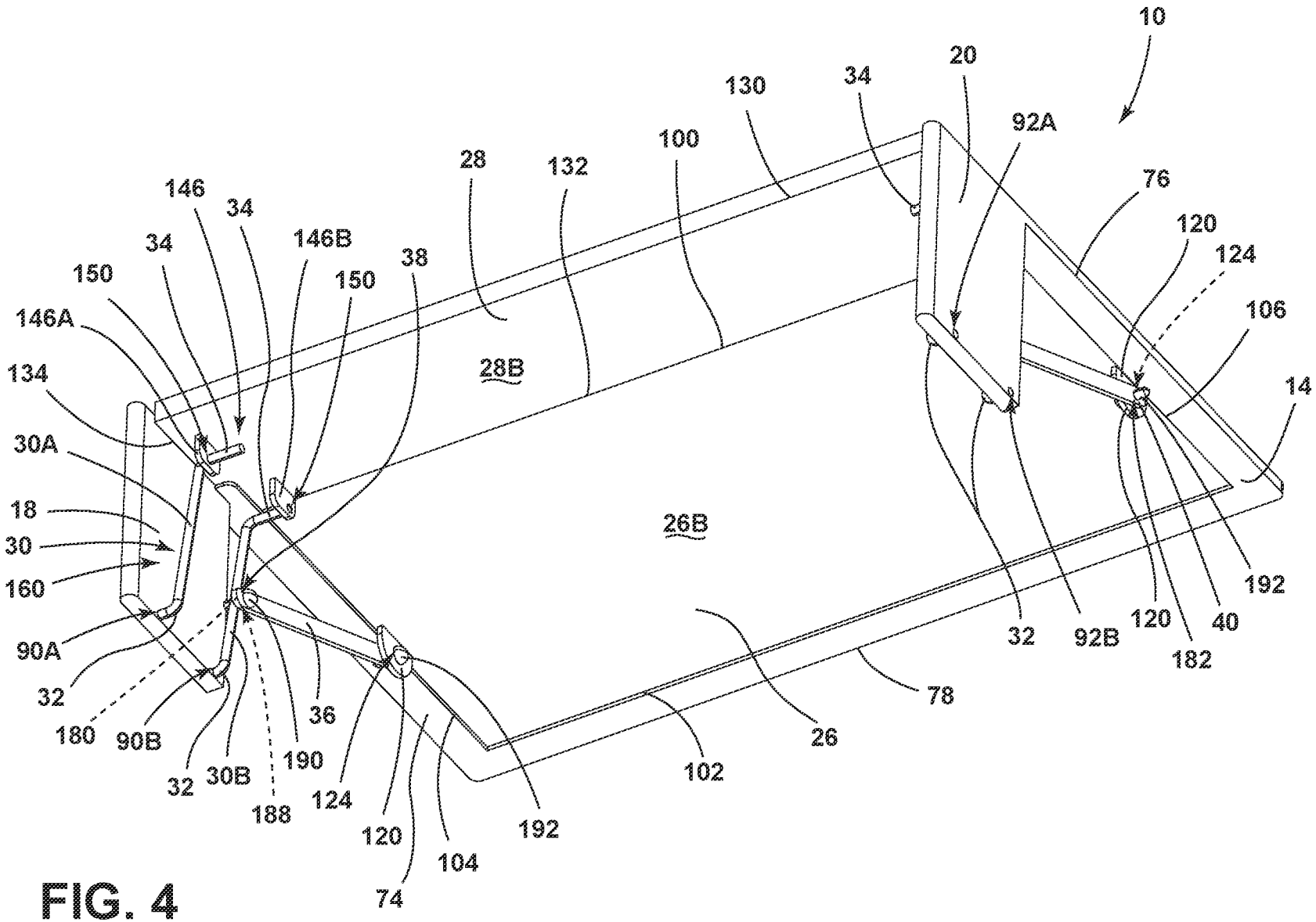
FIG. 4 is a bottom perspective view of the shelf assembly of FIG. 3.
Figure 8:
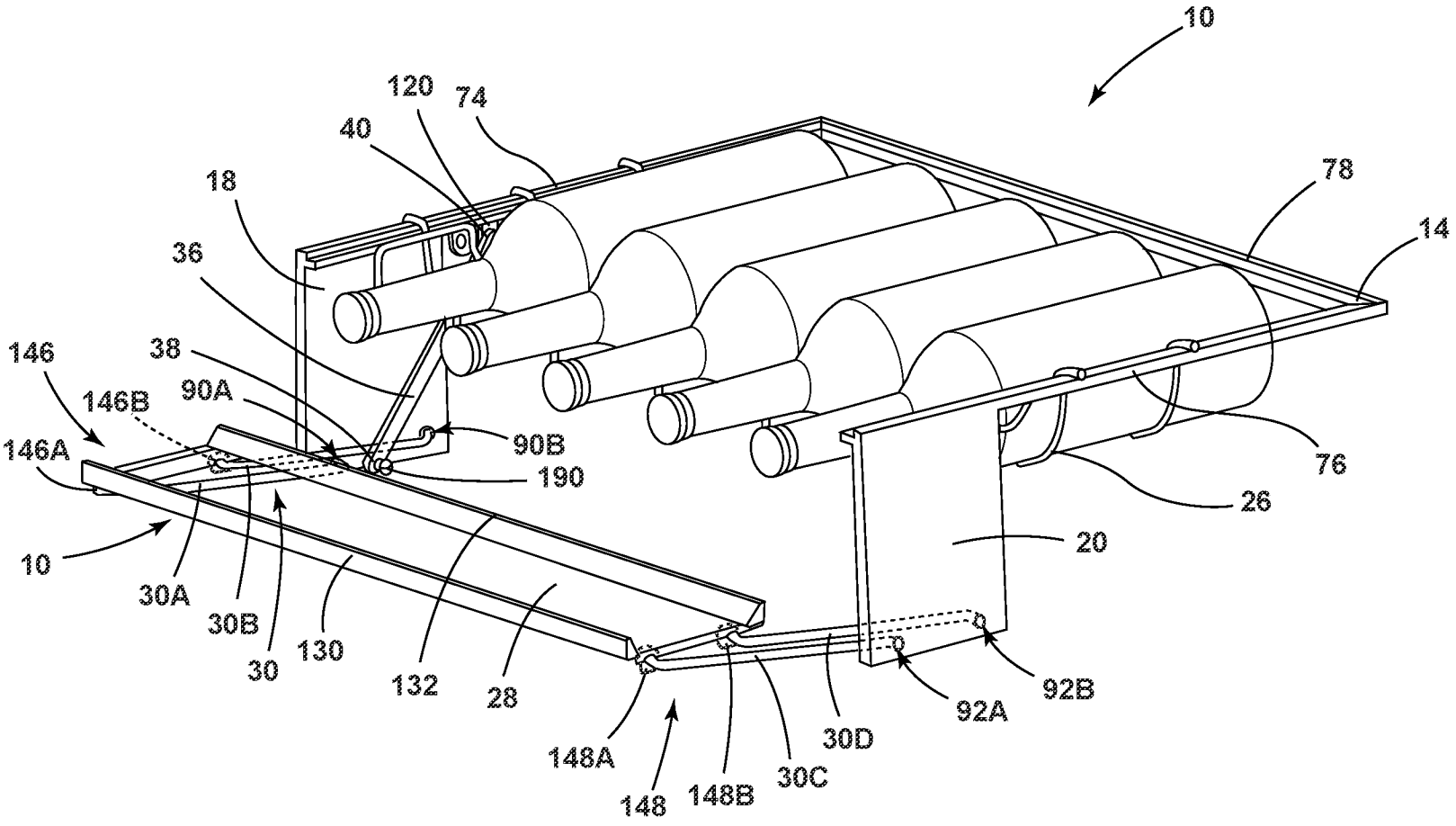
FIG. 8 is a top perspective view of a shelf assembly including a bottle rack, according to various examples.

It will be understood that the rear shelf portion 26 and/or the front shelf portion 28 may be configured as any form of supporting surface without departing from the scope of the present disclosure. For example, as illustrated in FIG. 3, the rear shelf portion 26 may include a rotatable plate 118 positioned on the upper surface 26A of the rear shelf portion 26. The rotatable plate 118 may include bearings, a track, or any other mechanism configured to allow the rotatable plate 118 to rotate. The rotatable plate 118 is configured to allow goods placed on the rear shelf portion 26 to be more readily accessible by rotating the rotatable plate 118 when the rear shelf portion 26 is in the forward or rearward position. It is contemplated that the rotatable plate 118 may be one of a plurality of plates positioned on the rear and front shelf portions 26, 28, may be positioned on the front shelf portion 28, or may be positioned in any position on the shelf assembly 10 to be accessible by a user without departing from the scope of the present disclosure. Further, as illustrated in FIG. 8, the rear shelf portion 26 of the shelf assembly 10 may be configured as a bottle rack. It is contemplated that the front shelf portion 28 may be configured as a bottle rack or that both the rear and front shelf portions 26, 28 may be configured as bottle racks without departing from the scope of the present disclosure.

Referring now to FIGS. 5A and 5B, a connection bracket 120 may extend downwardly from the lower surface 26B of the rear shelf portion 26. The connection bracket 120 may be coupled with the rear shelf portion 26, or the connection bracket 120 may be integrally formed with the rear shelf portion 26. As best shown in FIGS. 6-7B, the connection bracket 120 may define a rear receiving space 124. It will be understood that the connection bracket 120 may be one of a pair of connection brackets 120 extending downwardly adjacent the opposed side edges 104, 106 of the rear shelf portion 26, or may be a single connection bracket 120 extending downwardly from the lower surface 26B of the rear shelf portion 26 without departing from the scope of the present disclosure.

As best illustrated in FIGS. 3-7B, the front shelf portion 28 is substantially rectangular and includes a forward edge 130, a rear edge 132, a first side edge 134, a second side edge 136, and upper and lower surfaces 28A, 28B. It is contemplated that the front shelf portion 28 may be the same size as the rear shelf portion 26 or may be smaller or larger than the rear shelf portion 26. In various examples, one or both of the forward edge 130 and the rear edge 132 of the front shelf portion 28 may be a raised edge 140. The raised edge 140 may have substantially triangular cross-section configured such that an angled portion of the raised edge 140 is oriented away from the respective edge 130, 132. It is contemplated that the one or more raised edges 140 of the front shelf portion 28 may have the same size and shape as the one or more raised edges 110 of the rear shelf portion 26.

As best shown in FIG. 5B, the front shelf portion 28 may include a first set of rotation brackets 146 and a second set of rotation brackets 148 extending downwardly from the lower surface 28B of the front shelf portion 28. The first set of rotation brackets 146 includes first and second rotation brackets 146A, 146B that are positioned proximate the first side edge 134 of the front shelf portion 28 along the lower surface 28B thereof. As shown in FIG. 5B, the first rotation bracket 146A is positioned in a forward position relative to the second rotation bracket 146B. As further shown in FIG. 5B, the second rotation bracket 146B is inwardly inset relative to the first rotation bracket 146A. Similarly, the second set of rotation brackets 148 includes first and second rotation brackets 148A, 148B that are positioned proximate the second side edge 136 of the front shelf portion 28 along the lower surface 28B thereof. Thus, the first and second sets of rotation brackets 146, 148 are opposed sets of rotation brackets disposed on and outwardly extending from the lower surface 28B of the front shelf portion 28 on opposed sides thereof. As shown in FIG. 5B, the first rotation bracket 148A of the second set of rotation brackets 148 is positioned in a forward position relative to the second rotation bracket 148B. As further shown in FIG. 5B, the second rotation bracket 148B of the second set of rotation brackets 148 is also inwardly inset relative to the first rotation bracket 148A. Each of the first and second rotation brackets 146A, 146B and 148A, 148B are positioned in pairs, wherein the spacing of the first and second rotation brackets 146A, 146B of first set of rotation brackets 146 is substantially the same as the spacing of the first pair of receiving wells 90 of the first support 18. Similarly, the spacing of the first and second rotation brackets 148A, 148B of the second set of rotation brackets 148 is substantially the same as the spacing of the second pair of receiving wells 92 of the second support 20. As shown in FIG. 5B, the first and second rotation brackets 146A, 146B of the first set of rotation brackets 146 each include a receiving aperture 150 disposed therethrough. Similarly, the first and second rotation brackets 148A, 148B of the second set of rotation brackets 148 each include a receiving aperture 152 disposed therethrough.

As noted above, the plurality of rotatable arms 30 is configured to support the front shelf portion 28 rotatably between first and second positions. Each rotatable arm 30A-30D of the plurality of rotatable arms 30 includes an upper end 34 and a lower end 32. The upper and lower ends 32, 34 may extend substantially perpendicularly from the respective rotatable arm 30A-30D. The upper end 34 may extend in the same direction as the lower end 32, or the upper end 34 may extend opposite the direction of the lower end 32. As illustrated in FIGS. 5A and 5B, the plurality of rotatable arms 30 may be arranged in a first pair of rotatable arms 160 that is comprised of first and second rotatable arms 30A, 30B. The first rotatable arm 30A of the first pair of rotatable arms 160 is shown as being positioned in a forward position relative to the second rotatable arm 30B. The first pair of rotatable arms 160 is configured to be operably coupled with the first support 18, as further described below. The plurality of rotatable arms 30 also includes a second pair of rotatable arms 162 that is comprised of first and second rotatable arms 30C, 30D. The first rotatable arm 30C of the second pair of rotatable arms 162 is shown as being positioned in a forward position relative to the second rotatable arm 30D. The second pair of rotatable arms 162 is configured to be operably coupled with the second support 20, as further described below.

As best shown in FIGS. 4 and 6-7B, the upper ends 34 of the first pair of rotatable arms 160 of the plurality of rotatable arms 30 are configured to be received by the receiving apertures 150 of the first set of rotation brackets 146. Specifically, the upper end 34 of the first rotatable arm 30A is received in the receiving aperture 150 of the first rotation bracket 146A, while the upper end 34 of the second rotatable arm 30B is received in the receiving aperture 150 of the second rotation bracket 146B. Similarly, the upper ends 34 of the second pair of rotatable arms 162 of the plurality of rotatable arms 30 are configured to be received by the receiving apertures 152 of the second set of rotation brackets 148. Specifically, the upper end 34 of the first rotatable arm 30C is received in the receiving aperture 152 of the first rotation bracket 148A, while the upper end 34 of the second rotatable arm 30D is received in the receiving aperture 152 of the second rotation bracket 148B. Each upper end 34 of the rotatable arms 30A-30D is separately rotatable within the respective receiving apertures 150, 152. The lower ends 32 of the first pair of rotatable arms 160 of the plurality of rotatable arms 30 are configured to be received by the first pair of receiving wells 90 of the first support 18. Specifically, the lower end 32 of the first rotatable arm 30A is received in the first receiving well 90A of the first support 18, while the lower end 32 of the second rotatable arm 30B is received in the second receiving well 90B of the first support 18. Similarly, the lower ends 32 of the second pair of rotatable arms 162 of the plurality of rotatable arms 30 are configured to be received by the second pair of receiving wells 92 of the second support 20. Specifically, the lower end 32 of the first rotatable arm 30C is received in the first receiving well 92A of the second support 20, while the lower end 32 of the second rotatable arm 30D is received in the second receiving well 92B of the second support 20. Each lower end 32 of the rotatable arms 30A-30D is separately rotatable within the respective receiving well 90A, 90B, 92A, 92B. With the second rotatable arms 30B, 30D coupled to the second rotation brackets 146B, 148B, respectively, the second rotatable arms 30B, 30D are inwardly inset relative to the respective first rotatable arms 30A, 30C.

The plurality of rotatable arms 30 allows the front shelf portion 28 to be moved between the raised or first position shown in FIG. 6, and the lowered or second position shown in FIG. 7B along the downward and forward rotational path as indicated by arrow 29. As shown in FIG. 6, when the front shelf portion 28 is in the raised position, the rotatable arms 30A, 30B of the plurality of rotatable arms 30 are substantially vertical, and the rear edge 132 of the front shelf portion 28 is substantially aligned with the front edge 100 of the rear shelf portion 26. In this way, the front shelf portion 28 is substantially co-planar with the rear shelf portion 26 when the front shelf portion 28 is in the raised position. Thus, the upper surfaces 28A, 26A of the front and rear shelf portions 28, 26 provide for a substantially continuous shelf assembly 10 when the front shelf portion is in the raised position. In various examples, the rear edge 132 of the front shelf portion 28 may abut the front edge 100 of the rear shelf portion 26. When the front shelf portion 28 is in the intermediate position shown in FIG. 7A, the rotatable arms 30A, 30B of the plurality of rotatable arms 30 are rotated to be inclined forward toward the access opening 58 of the compartment 56. When the front shelf portion 28 is in the lowered or second position shown in FIG. 7B, the rotatable arms 30A, 30B of the plurality of rotatable arms 30 may be substantially horizontal. In the lowered position, the front shelf portion 28 is lowered and projected forward by the plurality of rotatable arms 30, such that the rear edge 132 of the front shelf portion 28 is no longer in contact with the front edge 100 of the rear shelf portion 26. Thus, the front shelf portion 28 rotates downward and forward from the raised position (FIG. 6) to the lowered position (FIG. 7B) along the path indicated by arrow 29. As shown in FIGS. 6-7B, the front shelf portion 28 remains substantially horizontal throughout its rotation between the raised position (FIG. 6) and the lowered position (FIG. 7B), such that objects supported on the upper surface 28A of the front shelf portion 28 will remain supported in a substantially upright abutting manner on the front shelf portion 28 during movement of the same. Thus, the front shelf portion 28 is substantially parallel with the rear shelf portion 26, and vertically spaced-apart from the rear shelf portion 26 when the front shelf portion 28 is in the lowered position.

As illustrated in FIGS. 6-7B, the shelf assembly 10 further includes the connecting arm 36. The connecting arm 36 interconnects the front shelf portion 28 and the rear shelf portion 26 to provide synchronized movement between the front and rear shelf portions 28, 26. The connecting arm 36 is contemplated to be a rigid member and includes a front end 38 and a rear end 40. The front end 38 of the connecting arm 36 defines a front aperture 180 that is rotatably coupled with one of the rotatable arms 30A-30D of the plurality of rotatable arms 30. In the embodiment shown in FIGS. 6-7B, the front end 38 of the connecting arm 36 is coupled to the second rotatable arm 30B of the first pair of rotatable arms 160. The rear end 40 of the connecting arm 36 defines a rear aperture 182 and is rotatably coupled with the rear shelf portion 26. In the embodiment shown in FIGS. 6-7B, the rear end 40 of the connecting arm 36 is coupled to the connection bracket 120 of the rear shelf portion 26. The connecting arm 36 may be a single connecting arm or may be one of a pair of connecting arms without departing from the scope of the present disclosure.

The rotatable arm 30A-30D configured to be coupled with the connecting arm 36 may define a through-hole 188 between the upper end 34 and the lower end 32 thereof. The through-hole 188 is shown as provided on rotatable arm 30B in FIGS. 6-7B. A first fastener 190 is received by the front aperture 180 and the through-hole 188 to couple the front end 38 of the connecting arm 36 with the respective rotatable arm 30. It is further contemplated that the front end 38 of the connecting arm 36 may be coupled with the upper end 34 of one of the plurality of rotatable arms 30 and/or the front shelf portion 28 without departing from the scope of the present disclosure.

The rear aperture 182 is aligned with the rear receiving space 124 of the connection bracket 120. A second fastener 192 extends through the rear aperture 182 of the connecting arm 36 and through the rear receiving space 124 of the connection bracket 120 to couple the connecting arm 36 with the rear shelf portion 26. It is contemplated that the rear receiving space 124 may be a generally circular hole, as illustrated, or may be a slot without departing from the scope of the present disclosure.

With further reference to FIGS. 6-7B, the connecting arm 36 of the shelf assembly 10 is configured to link the movement of the front shelf portion 28 with the movement of the rear shelf portion 26, such that the forward position of the rear shelf portion 26 corresponds with the lowered position of the front shelf portion 28. Similarly, the rearward position of the rear shelf portion 26 corresponds with the raised position of the front shelf portion 28. When the front shelf portion 28 is rotated from the raised position to the lowered position, the front end 38 of the connecting arm 36 is moved downward and forward. The rear end 40 of the connecting arm 36 is simultaneously moved forward, pulling the rear shelf portion 26 from the rearward position toward the forward position in the substantially horizontal direction as indicated by arrow 27. This movement is configured to provide increased access to the front shelf portion 28 and the rear shelf portion 26. When the front shelf portion 28 is moved from the lowered position to the raised position, the connecting arm 36 pushes the rear shelf portion 26 from the forward position to the rearward position along the path as indicated by arrow 27. As shown in FIGS. 6-7B, the connecting arm 36 may be a substantially linear member directly connecting the rear shelf portion 26 with the rotatable arm 30B.

Referring now to FIG. 9, in various examples a spring 300 may be coupled with the shelf support 14 and the rear shelf portion 26. The spring 300 may be one of a pair of springs with each of the pair of springs 300 by positioned proximate one of the first and second side members 74, 76 of the shelf support 14. As illustrated, the spring 300 may be coupled with the rear member 78 of the shelf support 14 and extends forward of the rear member 78. The spring 300 is further coupled with the connection bracket 120 of the rear shelf portion 26 and is configured to bias the rear shelf portion 26 into the rearward position. The bias of the spring 300 further prevents inadvertent movement of the front shelf portion 28 from the raised position (e.g., the spring 300 may prevent the front shelf portion 28 from falling into the lowered position).

When a user moves the front shelf portion 28 from the raised position into the lowered position, the connecting arm 36 pulls the rear shelf portion 26 from the rearward position toward the forward position. When the rear shelf portion 26 slides forward along the shelf support 14 from the rearward position into the forward position, the forward movement of the rear shelf portion 26 applies a force against the bias of the spring 300. The spring 300 is loaded as the rear shelf portion 26 is moved into the forward position, and the rotation of the plurality of rotatable arms 30 to a horizontal position prevents the spring 300 from inadvertently biasing the rear shelf portion 26 back into the rearward position. When a user moves the front shelf portion 28 up from the lowered position into the raised position, the spring 300 is unloaded and biases the rear shelf portion 26 into the rearward position. This bias may be configured to ease the movement of the front shelf portion 28 into the raised position. For example, the spring 300 may be configured to pull the rear shelf portion 26 into the rearward position and simultaneously move the front shelf portion 28 into the raised position when the front shelf portion 28 is moved upward to a certain degree. This may reduce the force needed to move the front shelf portion 28 into the raised position and the rear shelf portion 26 into the rearward position.

Referring now to FIGS. 10-13, a second exemplary embodiment of the shelf assembly 10 is illustrated. Where the features of the second exemplary embodiment are the same or similar to the features of the first exemplary embodiment previously discussed, the same numbers have been used. It will further be understood that the various features of each exemplary embodiment may be combined or interchanged without departing from the scope of the present disclosure.

In the embodiment shown in FIG. 10, the rotatable arms 30A-30D of the plurality of rotatable arms 30 are shown directly coupled with the first and second sidewalls 22, 24 of the cabinet liner 16. As illustrated in FIGS. 9 and 10, the front shelf portion 28 and the rear shelf portion 26 may be each at least partially supported by the shelf support 14. In other examples, the rear shelf portion 26 is supported by the shelf support 14 in the front shelf portion 28 is supported by the plurality of rotatable arms 30. As previously discussed, each of the first and second side members 74, 76 may include an inwardly extending support rail 86. The rear member 78 may further include an inwardly extending support rail 86 extending away from a rear wall 200 of the cabinet liner 16.

The first sidewall 22 of the cabinet liner 16 defines the first pair of receiving wells 90 having first and second receiving wells 90A, 90B. The second sidewall 24 of the cabinet liner 16 defines the second pair of receiving wells 92 having first and second receiving wells 92A, 92B. The first pair of receiving wells 90 are positioned below the first side member 74 of the shelf support 14, and the second pair of receiving wells 92 are positioned below the second side member 76 of the shelf support 14. The second pair of receiving wells 92 are defined to mirror the size, position, and spacing of the first pair of receiving wells 90. It is contemplated that the first and second pairs of receiving wells 90, 92 may be reinforced with inserts 202 for support.

It will be understood that the rear shelf portion 26 and the front shelf portion 28 have the same configurations previously discussed with respect to FIGS. 2-8 and that the rear shelf portion 26 and the front shelf portion 28 may each include one or more raised edges 110, 140 and/or the rotatable plate 118. The rear shelf portion 26 is slidably coupled with the shelf support 14 and is movable between the forward position and the rearward position. For example, the first and second side edges 104, 106 of the rear shelf portion 26 may be slidably coupled with the inwardly extending support rails 86 of the shelf support 14 or may be coupled with a rail assembly (not shown) coupled with or integrally formed with the inwardly extending support rails 86 and/or the first and second side members 74, 76. When the rear shelf portion 26 is in the rearward position, the rear edge 102 of the rear shelf portion 26 is aligned with and/or abuts the rear member 78 of the shelf support 14. When the rear shelf portion 26 is in the forward position, the rear edge of the rear shelf portion 26 is spaced-apart from the rear member 78 of the shelf support 14.

Figure 12:
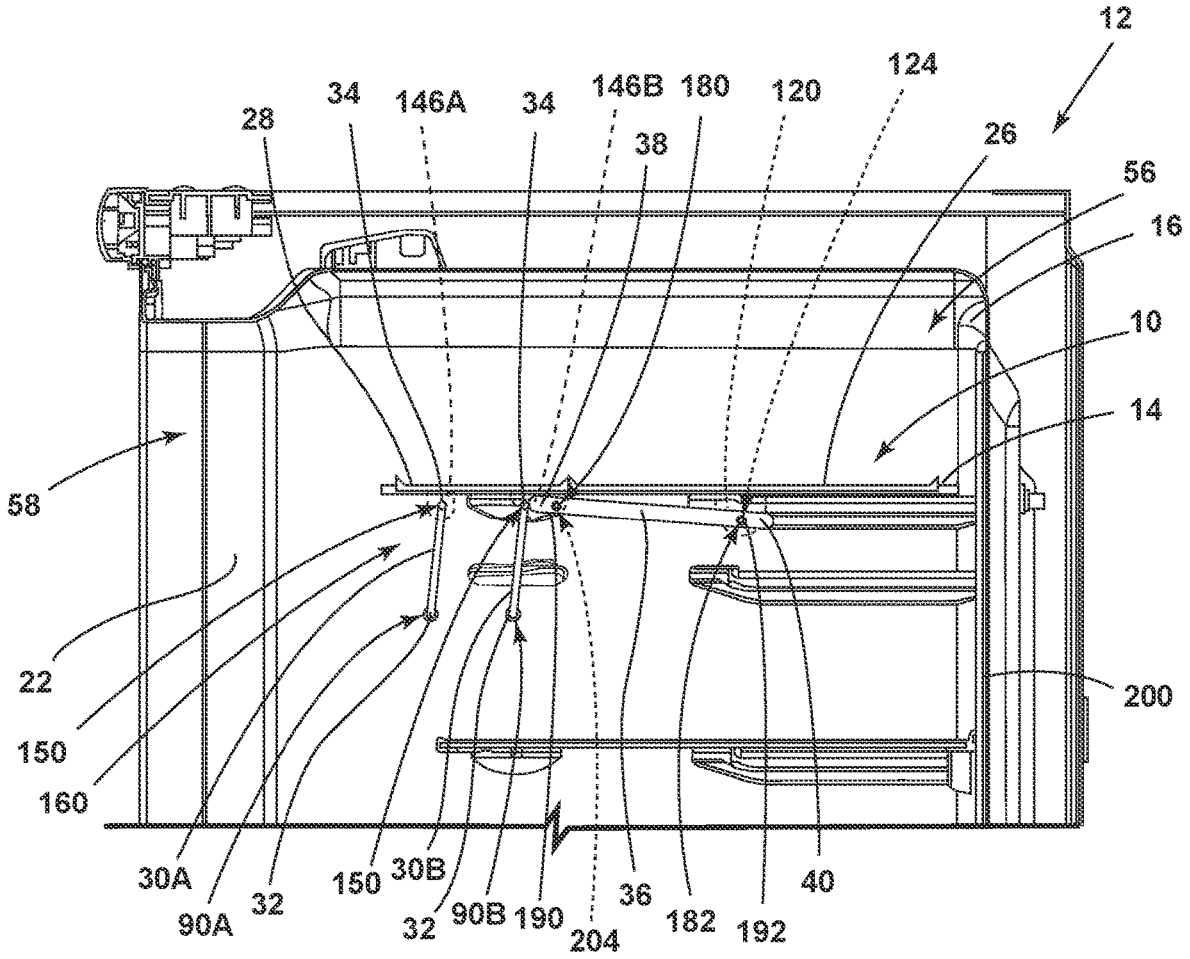
FIG. 12 is a cross-sectional view of the shelf assembly of FIG. 10 with the shelf assembly in a first position.
Figure 13:
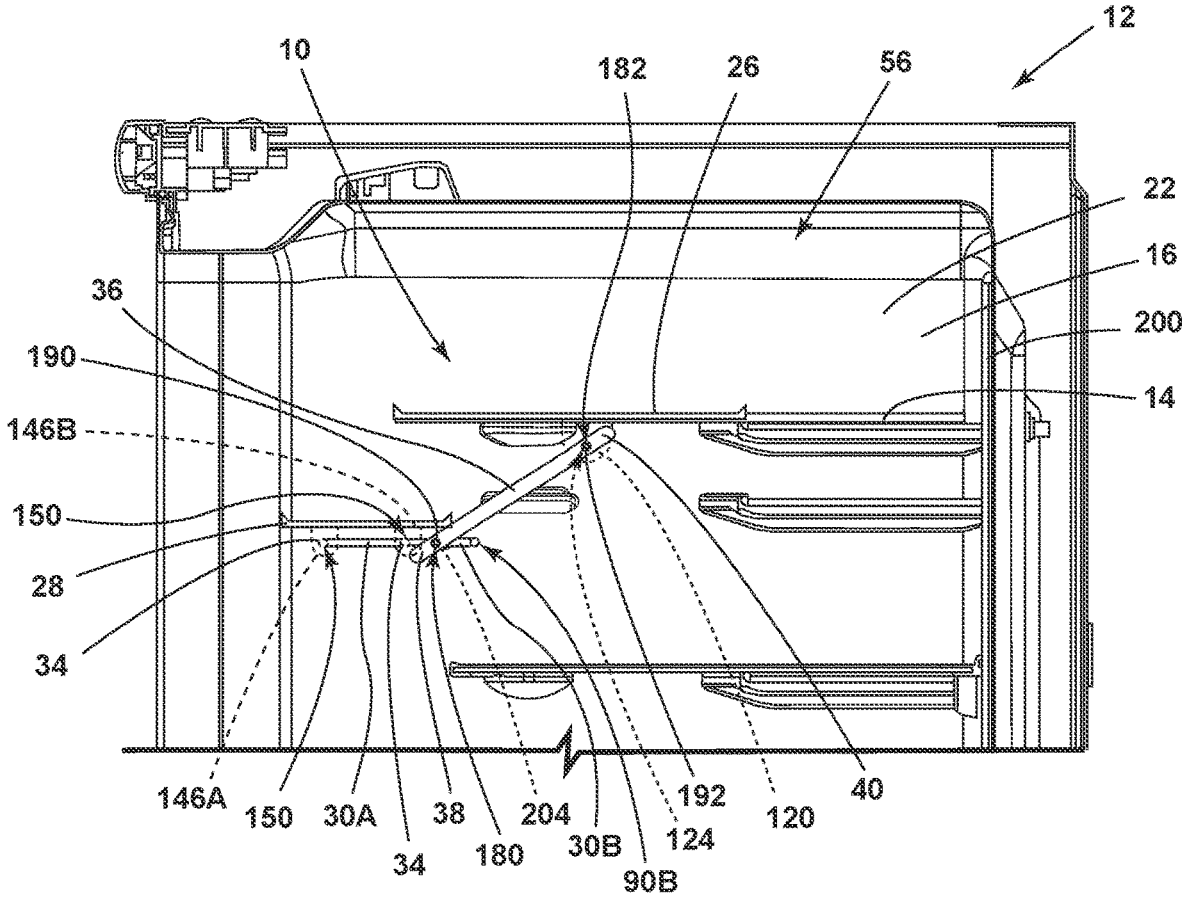
FIG. 13 is a cross-sectional view of the shelf assembly of FIG. 10 with the shelf assembly in a second position.

As illustrated in FIGS. 12 and 13, the connection bracket 120 may extend downward from the rear shelf portion 26, as previously discussed, and may be coupled with the rear shelf portion 26. Alternatively, the connection bracket 120 may be integrally formed with the rear shelf portion 26. The connection bracket 120 defines the rear receiving space 124. It will be understood that the connection bracket 120 may be one of a pair of brackets or may be a single bracket without departing from the scope of the present disclosure.

The front shelf portion 28 includes the first set of rotation brackets 146 (having first and second rotation brackets 146A, 146B), and the second set of rotation brackets 148 (having first and second rotation brackets 148A, 148B), all of which extend downwardly from the lower surface 28B of the front shelf portion 28. The first set of rotation brackets 146 are positioned proximate the first side edge 134 of the front shelf portion 28, and the second set of rotation brackets 148 are positioned proximate the second side edge 136 of the front shelf portion 28, such that the first and second sets of rotation brackets 146, 148 are disposed on opposed sides of the front shelf portion 28. The spacing of the first and second rotation brackets 146A, 146B of the first set of rotation brackets 146 is substantially the same as the spacing of the first pair 90 of receiving wells 90A, 90B, and the spacing of the first and second rotation brackets 148A, 148B of the second set of rotation brackets 148 is substantially the same as the pacing of the second pair 92 of receiving wells 92A, 92B. Each of the first and second sets of rotation brackets 146, 148 define receiving apertures 150, 152, respectively.

The rotatable arms 30A-30D are configured to support the front shelf portion 28, as previously discussed with respect to FIGS. 2-8. As illustrated, the plurality of rotatable arms 30 may be arranged in first and second pairs 160, 162. The upper ends 34 of the first pair 160 of rotatable arms 30A, 30B are configured to be received by the receiving apertures 150 of the first set of rotation brackets 146, and the upper ends 34 of the second pair 162 of rotatable arms 30C, 30D are configured to be received by the receiving apertures 152 of the second set of rotation brackets 148. Each upper end 34 is rotatable within the respective receiving aperture 150, 152. The lower ends 32 of the first pair 160 of rotatable arms 30A, 30B are configured to be received by the first pair of receiving wells 90 of the first sidewall 22 of the cabinet liner 16, and the lower ends 32 of the second pair 162 of rotatable arms 30C, 30D are configured to be received by the second pair of receiving wells 92 of the second sidewall 24 of the cabinet liner 16. Each lower end 32 is rotatable within the respective receiving well 90, 92.

As previously discussed, and as illustrated in FIGS. 12 and 13, the positioning of the upper ends 34 within the respective receiving apertures 150, 152 and the positioning of the lower ends 32 within the respective receiving wells 90, 92 provides support for the front shelf portion 28 and allows the front shelf portion 28 to be moved between the raised position and the lowered position. When the front shelf portion 28 is in the raised position, the rotatable arms 30A, 30B of the plurality of rotatable arms 30 are substantially vertical, and the rear edge 132 of the front shelf portion 28 is substantially aligned with the front edge 100 of the rear shelf portion 26. In various examples, the rear edge 132 of the front shelf portion 28 may contact the front edge 100 of the rear shelf portion 26. When the front shelf portion 28 is in the lowered position, the rotatable arms 30A, 30B of the plurality of rotatable arms 30 are rotated to be inclined forward toward the access opening 58 of the compartment 56. In various examples, the plurality of rotatable arms 30 may be substantially horizontal when the front shelf portion 28 is in the lowered position.

The shelf assembly 10 further includes the connecting arm 36. The connecting arm 36 is configured to couple the front shelf portion 28 with the rear shelf portion 26. The connecting arm 36 may be a linear and rigid member that includes the front end 38 and the rear end 40. The front end 38 defines the front aperture 180 and is rotatably coupled with the front shelf portion 28, and the rear end 40 defines the rear aperture 182 and is rotatably coupled with the rear shelf portion 26.

Referring still to FIGS. 12 and 13, one of the rotation brackets 146A, 146B, 148A, 148B of the front shelf portion 28 further defines a through-hole 204 configured to be aligned with the front aperture 180 of the connecting arm 36. The through-hole 204 is defined rearward of the receiving aperture 150, 152 of the respective rotation bracket 146A, 146B, 148A, 148B. The first fastener 190 is received by the front aperture 180 and the through-hole 204 to couple the front end 38 of the connecting arm 36 with the respective rotatable arm 30. Alternatively, the upper end 34 of one of the rotatable arms 30A-30D of the plurality of rotatable arms 30 may be received by the front aperture 180 of the connecting arm 36 to operably couple the connecting arm 36 with the front shelf portion 28.

The rear aperture 182 is aligned with the rear receiving space 124 of the connection bracket 120. A second fastener 192 extends through the rear aperture 182 of the connecting arm 36 and the rear receiving space 124 of the connection bracket 120 to couple the connecting arm 36 with the rear shelf portion 26. It is contemplated that the rear receiving space 124 may be a generally circular hole, as illustrated, or may be a slot without departing from the scope of the present disclosure.

Referring now to FIGS. 2-13, the connecting arm 36 of the shelf assembly 10 is configured to link the movement of the front shelf portion 28 with the movement of the rear shelf portion 26, such that the forward position of the rear shelf portion 26 corresponds with the lowered position of the front shelf portion 28, and the rearward position of the rear shelf portion 26 corresponds with the raised position of the front shelf portion 28. When the front shelf portion 28 is moved from the raised position to the lowered position, the front end 38 of the connecting arm 36 is moved downward and forward. The rear end 40 of the connecting arm 36 is simultaneously moved forward, pulling the rear shelf portion 26 from the rearward position to the forward position in a substantially horizontal direction as indicated by arrow 27. This movement is configured to provide increased access to the front shelf portion 28 and the rear shelf portion 26. When the front shelf portion 28 is moved from the lowered position to the raised position, the connecting arm 36 pushes the rear shelf portion 26 from the forward position to the rearward position along the path as indicated by arrow 27.

According to one aspect, a shelf assembly for an appliance may include a shelf support operably coupled with a cabinet liner. First and second supports are positioned below the shelf support. The first and second supports are positioned on opposing sidewalls of the cabinet liner. A rear shelf portion is slidably supported on the shelf support between rearward and forward positions. A front shelf portion is positioned adjacent to the rear shelf portion and is movable between a raised position and a lowered position. A plurality of rotatable arms are configured to support the front shelf portion. Each rotatable arm of the plurality of rotatable arms is operably coupled with one of the first and second supports at a first end and is further operably coupled with the front shelf portion at a second end. A connecting arm interconnects the rear shelf portion and the front shelf portion.

According to another aspect, a front shelf portion may be substantially co-planar with a rear shelf portion when the front shelf portion is in a raised position.

According to another aspect, a front shelf portion may be substantially parallel with a rear shelf portion and may be vertically spaced-apart from the rear shelf portion when the front shelf portion is in a lowered position.

According to another aspect, a front shelf portion may rotate downward and forward from a raised position to a lowered position. A rear shelf portion may move from a rearward position to a forward position as the front shelf portion moves from the raised position to the lowered position.

According to another aspect, a front shelf portion may include first and second sets of rotation brackets extending downwardly from a lower surface of the front shelf portion on opposed sides of the front shelf portion. The first of rotation brackets may include a first bracket and an inwardly inset second bracket. The second set of rotation brackets may include a first bracket and an inwardly inset second bracket.

According to another aspect, a plurality of rotatable arms may include first and second pairs of rotatable arms. The first pair of rotatable arms may include first and second rotatable arms operably coupled with first and second brackets of a first pair of rotation brackets of a front shelf portion. The second pair of rotatable arms may include first and second rotatable arms operably coupled with first and second brackets of a second pair of rotation brackets of the front shelf portion.

According to another aspect, a shelf assembly for an appliance may include a shelf support operably coupled with a cabinet liner. A rear shelf portion is slidably coupled with the shelf support and is movable between a forward position and a rearward position. A front shelf portion is positioned forward of the rear shelf portion and is movable between a raised position and a lowered position. At least one rotatable arm is configured to support the front shelf portion. The at least one rotatable arm is operably coupled with the cabinet liner at a first end and is operably coupled with the front shelf portion at a second end. A connecting arm is operably coupled with the rear shelf portion at a first end and is operably coupled with the front shelf portion at a second end.

According to another aspect, a rear shelf portion may be in a rearward position when a front shelf portion is in a raised position.

According to another aspect, a rear shelf portion may be in a forward position when a front shelf portion is in a lowered position.

According to another aspect, a shelf assembly may include a rotation bracket extending downwardly from a front shelf portion. A second end of a connecting arm may be operably coupled with the rotation bracket. A second end of at least one rotatable arm is operably coupled with the rotation bracket.

According to another aspect, a rear shelf portion may include a downwardly extending connection bracket. A first end of a connecting arm is operably coupled with the connection bracket.

According to another aspect, a shelf assembly for an appliance may include a shelf support operably coupled with a cabinet liner. A rear shelf portion is slidably coupled with the shelf support between first and second positions. A front shelf portion is positioned forward of the rear shelf portion and is movable between first and second positions. The front shelf portion is substantially co-planar with the rear shelf portion when the front shelf portion is in the first position. A plurality of rotatable arms interconnect the front shelf portion and the cabinet liner. A connecting arm interconnects the rear shelf portion and one of the rotatable arms of plurality of rotatable arms.

According to another aspect, a shelf assembly may include a connection bracket positioned on a rear shelf portion. A first end of a connecting arm may be operably coupled with the connection bracket.

According to another aspect, a shelf assembly may include first and second supports positioned on opposing sidewalls of a cabinet liner and operably coupled with a plurality of rotatable arms.

According to another aspect, first and second supports may be integrally formed with a shelf support as a unitary member.

According to another aspect, a front shelf portion may be substantially parallel with a rear shelf portion and vertically spaced-apart from the rear shelf portion when the front shelf portion is in a second position.

According to another aspect, a plurality of rotatable arms may include first and second pairs of rotatable arms coupled to opposed sides of a liner and opposed sides of a front shelf portion.

According to another aspect, a rear shelf portion may be in the first position when a front shelf portion is in a first position.

According to another aspect, a rear shelf portion may be in a second position when a front shelf portion is in a second position.

According to another aspect, a shelf assembly may include a rotatable plate operably coupled with one of a front shelf portion and a rear shelf portion.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

The invention claimed is:

1. A shelf assembly for an appliance, comprising:

a shelf support having first and second side members positioned on opposite sides of the shelf support, wherein first and second supports downwardly extending from the first and second side members at front portions thereof;

a rear shelf portion slidably supported on the shelf support between rearward and forward positions;

a front shelf portion positioned adjacent to the rear shelf portion and movable between a raised position and a lowered position, wherein the front shelf portion includes first and second sets of rotation brackets extending downwardly from a lower surface of the front shelf portion on opposed sides of the front shelf portion, wherein the first set of rotation brackets includes a first bracket and an inwardly inset second bracket, and further wherein the second set of rotation brackets includes a first bracket and an inwardly inset second bracket; and a plurality of rotatable arms, wherein each rotatable arm of the plurality of rotatable arms is operably coupled with one of the first and second supports at a first end and is further operably coupled with the front shelf portion at a second end.

2. The shelf assembly of claim 1, wherein the front shelf portion is substantially co-planar with the rear shelf portion when the front shelf portion is in the raised position.

3. The shelf assembly of claim 2, wherein the front shelf portion is substantially parallel with the rear shelf portion and vertically spaced-apart from the rear shelf portion when the front shelf portion is in the lowered position.

4. The shelf assembly of claim 1, including:

a connecting arm interconnecting the rear shelf portion with at least one rotatable arm of the plurality of rotatable arms, wherein the rear shelf portion moves from the rearward position to the forward position as the front shelf portion moves from the raised position to the lowered position.

5. The shelf assembly of claim 1, wherein the plurality of rotatable arms includes first and second pairs of rotatable arms.

6. The shelf assembly of claim 5, wherein the first pair of rotatable arms includes first and second rotatable arms operably coupled with the first and second brackets of the first pair of rotation brackets of the front shelf portion, and further wherein the second pair of rotatable arms includes first and second rotatable arms operably coupled with the first and second brackets of the second pair of rotation brackets of the front shelf portion.

7. The shelf assembly of claim 4, including:

a connection bracket extending downwardly from a lower surface of the rear shelf portion, wherein a first end of the connecting arm is coupled to the connection bracket, and further wherein a second end of the connecting arm is coupled to the at least one rotatable arm of the plurality of rotatable arms.

8. An appliance having a shelf assembly, comprising:

a cabinet liner having a sidewall;

a shelf support operably coupled with the sidewall of the cabinet liner;

front and rear shelf portions supported by the shelf support, wherein the front shelf portion is positioned forward of the rear shelf portion and rotatably movable between first and second positions, wherein the rear shelf portion is slidably supported on the shelf support between first and second positions, and further wherein the rear shelf portion includes first and second connection brackets extending downwardly from a lower surface of the rear shelf portion;

first and second pairs of rotatable arms interconnecting the front shelf portion and the sidewall of the cabinet liner, wherein the first pair of rotatable arms includes first and second rotatable arms, and further wherein the second pair of rotatable arms includes first and second rotatable arms;

a first connecting arm interconnecting the first connection bracket of the rear shelf portion and one of the rotatable arms of the first pair of rotatable arms; and a second connecting arm interconnecting the second connection bracket of the rear shelf portion and one of the rotatable arms of the second pair of rotatable arms.

9. The shelf assembly of claim 8, further comprising:

first and second connection brackets positioned on the rear shelf portion, wherein a first end of the first connecting arm is operably coupled with the first connection bracket, and further wherein a first end of the second connecting arm is operably coupled with the second connection bracket.

10. The shelf assembly of claim 8, further comprising:

first and second supports positioned on opposing sidewalls of the cabinet liner and operably coupled with the plurality of rotatable arms.

11. The shelf assembly of claim 10, wherein the first and second supports are integrally formed with the shelf support as a unitary member.

12. The shelf assembly of claim 8, wherein the front shelf portion is substantially parallel with the rear shelf portion and vertically spaced-apart from the rear shelf portion when the front shelf portion is in the second position.

13. The shelf assembly of claim 8, wherein the first and second pairs of rotatable arms are disposed on opposed sides of the liner and opposed sides of the front shelf portion.

14. The shelf assembly of claim 8, wherein the rear shelf portion is in the first position when the front shelf portion is in the first position.

15. The shelf assembly of claim 14, wherein the rear shelf portion is in the second position when the front shelf portion is in the second position.

16. The shelf assembly of claim 8, further comprising:

a rotatable plate operably coupled with one of the front shelf portion and the rear shelf portion.

17. The shelf assembly of claim 8, wherein the front shelf portion is substantially co-planar with the rear shelf portion when the front shelf portion is in the first position.

* * * * *